US006318317B1

(12) United States Patent
Hubschle

(10) Patent No.: US 6,318,317 B1
(45) Date of Patent: Nov. 20, 2001

(54) DEVICE FOR INTERRUPTING THE POWER FLOW BETWEEN AT LEAST ONE VALVE AND AT LEAST ONE CAM OF CAMSHAFT

(75) Inventor: Peter Hubschle, Heilbronn (DE)

(73) Assignee: Audi AG, Ingolstadt (DE)

( * ) Notice: Subject to any disclaimer, the term of this patent is extended or adjusted under 35 U.S.C. 154(b) by 0 days.

(21) Appl. No.: 09/600,543

(22) PCT Filed: Dec. 21, 1998

(86) PCT No.: PCT/EP98/08378

§ 371 Date: Oct. 18, 2000

§ 102(e) Date: Oct. 18, 2000

(87) PCT Pub. No.: WO99/37894

PCT Pub. Date: Jul. 29, 1999

(30) Foreign Application Priority Data

Jan. 21, 1998 (DE) ..... 198 01 964

(51) Int. Cl.[7] ..... F01L 13/00

(52) U.S. Cl. ..... 123/90.16; 123/90.42; 123/198 F

(58) Field of Search ..... 123/90.15, 90.16, 123/90.17, 90.39, 90.41, 90.42, 90.43, 90.44, 90.46, 90.6, 198 F

(56) References Cited

U.S. PATENT DOCUMENTS

| | | | | |
|---|---|---|---|---|
| 4,762,096 | | 8/1988 | Kamm et al. . | |
| 5,544,626 | | 8/1996 | Diggs et al. . | |
| 5,622,145 | * | 4/1997 | Hara | 123/90.16 |
| 5,623,897 | | 4/1997 | Hampton et al. . | |
| 5,899,180 | * | 5/1999 | Fischer | 123/90.16 |
| 6,112,711 | * | 9/2000 | Shimizu et al. | 123/90.16 |

FOREIGN PATENT DOCUMENTS

| | | |
|---|---|---|
| 2753197 | 11/1977 | (DE) . |
| 42 05 230 A1 | 8/1993 | (DE) . |
| 42 26 163 A1 | 2/1994 | (DE) . |
| 295 19 593 U1 | 5/1997 | (DE) . |
| 0 796 982 A1 | 9/1997 | (EP) . |
| 2311179 | 12/1976 | (FR) . |
| WO 94/03709 | 2/1994 | (WO) . |

* cited by examiner

*Primary Examiner*—Weilun Lo
(74) *Attorney, Agent, or Firm*—Lalos & Keegan

(57) ABSTRACT

The invention relates to a device for interrupting the power flow between at least one valve and at least one cam of a camshaft, especially in a valve mechanism of a reciprocating internal combustion engine. The device comprises a first actuating lever cooperating with the at least one valve, a second actuating lever that is pivotally mounted in relation to the first actuating lever cooperating with the at least one cam of the camshaft and a coupling element arranged in such a way that it can rotate about an axis parallel to the swiveling axis of the second actuating lever. The coupling element couples both actuating levers in a first swiveling position and decouples both actuating levers in a second swiveling position. In order to reduce overall dimensions, the first actuating lever is mounted on fixed compensation elements and carries the swiveling axis for locating the second actuating lever.

4 Claims, 3 Drawing Sheets

Figure 1:
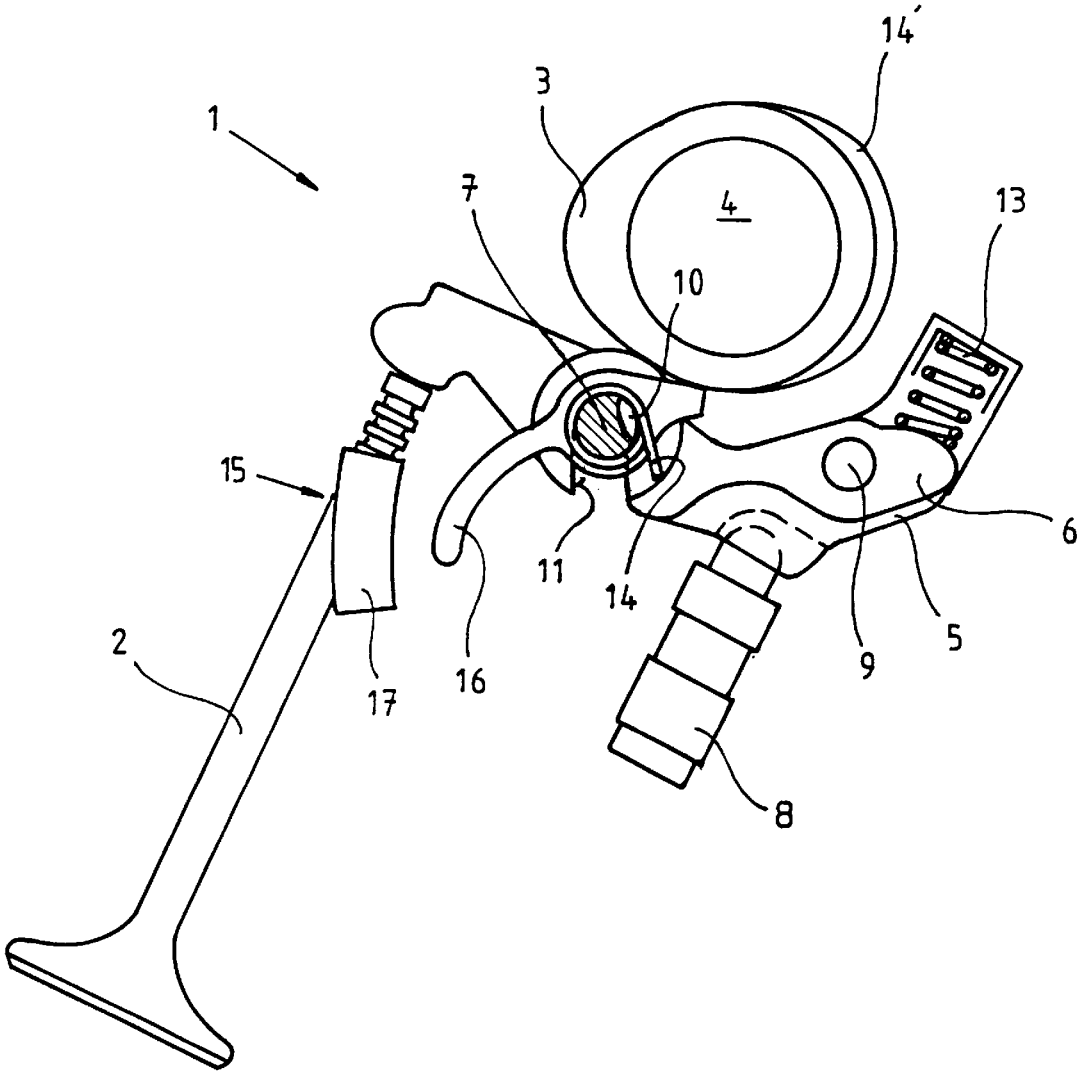

DEVICE FOR INTERRUPTING THE POWER FLOW BETWEEN AT LEAST ONE VALVE AND AT LEAST ONE CAM OF CAMSHAFT

DESCRIPTION

This invention relates to a device interrupting the force flow between at least one valve and at lease one cam of a camshaft, especially in valve operation of a reciprocating internal combustion engine.

A device such as this is disclosed in DE 27 53 197 A. The coupling element between the first and the second control levers is a pivotably mounted locking member actuated by a rod of an electromagnetic positioning member mounted so as to be stationary. The result is a structure which is relatively costly from the viewpoint of structural space and weight.

Another device for control of different valve control times in a multivalve internal combustion engine is disclosed in reference DE 42 05 230 A1. The device described in this reference has three first levers which are pivotable about a common first axis and each of which operates in conjunction with an intake valve and a cam for a first engine speed range, a second lever which is mounted between the adjacent first levers, and operates in conjunction with a cam for a second engine speed range, and a coupling element between the first set of levers and the second lever, in order to couple and decouple these levers in the first engine speed range. For this purpose the coupling element extends parallel to the axes of rotation of the levers and is rotatable between a first position in which it couples the first and the second levers to each other and a second position in which it uncouples the first and the second levers.

It is the object of this invention to design on the basis of this state of the art a device interrupting the force flow between at least one valve and at least one cam of a camshaft, which device takes up an especially small structural space and accordingly may be employed in very cramped spaces. In addition, this device is to be of a design which is simple and reliable in operation and the manufacture of which is cost-effective.

This object is attained in that the rotating coupling is mounted in the second actuating lever and carries a freely rotating roller which comes into direct contact with the cam of the camshaft. This results in an especially compact structural arrangement with low frictional losses. In addition, a corresponding cam slide surface may be provided on the second actuating lever.

In a development of this invention the rotating coupling element has in the area of its engagement with the first actuating lever a cross-section such that in its first rotary position it engages the undercut of a curved recess in the first actuating lever and is disengaged in its second rotary position. Switching back and forth between coupling or decoupling of the first and second actuating levers can thus be effected by rotation of the coupling element through approximately 120 degrees.

The coupling element can be moved into its first rotary position by means of a first rotating mechanism, into its second rotary position by means of a second mechanical or hydraulic rotating mechanism, and may be kept in its second rotary position by an electromagnetic locking mechanism. A torsion bar, for example, may be suggested for keeping the first rotary mechanism in operation at all times. The second, periodically operating, rotary mechanism may be represented in particular by a special cam on the camshaft.

The first mechanical rotary mechanism thus acts to sustain the first rotary position, which corresponds to the coupled state of the first and second actuating levers, while the second mechanical or hydraulic rotary mechanism serves to sustain the second rotary position, which corresponds to the uncoupled state of the first and second actuating levers. The electromagnetic locking mechanism, in contrast, serves exclusively to maintain the second rotary position.

In order to switch from the coupled to the uncoupled state it is necessary for the constantly acting force of the first mechanical rotary mechanism to be overcome by the periodically or occasionally acting force of the second mechanical rotary mechanism. The electromagnetic locking mechanism is activated only if the periodically recurring second rotary position is to be sustained by the second rotary mechanism, so that the force flow between the valve and the cam of the camshaft is interrupted. In this way the electromagnetic locking mechanism may be relatively small in size, since it performs exclusively a locking function with respect to the coupling element rather than, for example, a movement function.

This invention is explained with reference to the following drawing, of which

Figure 2:
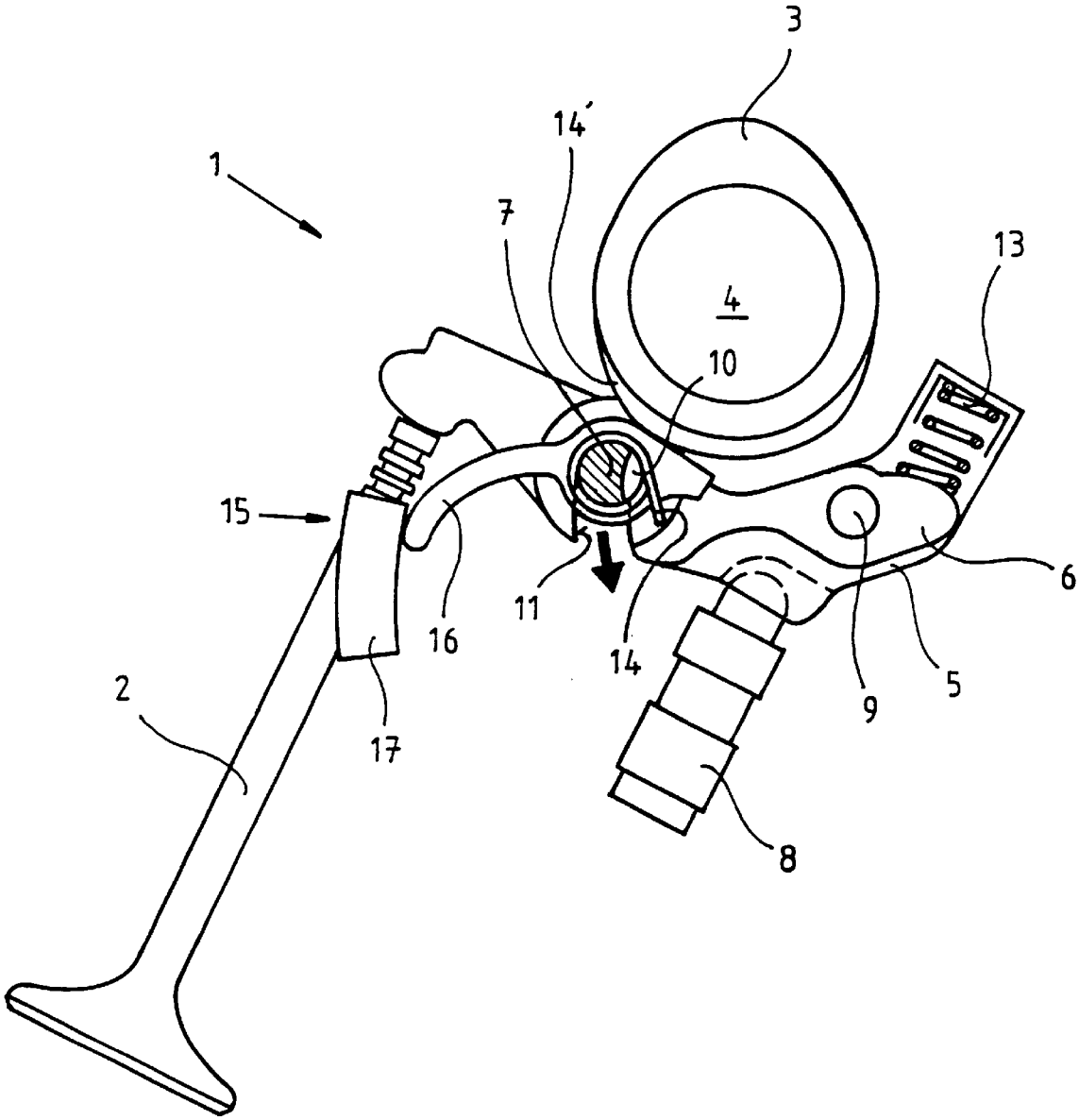
Figure 3:
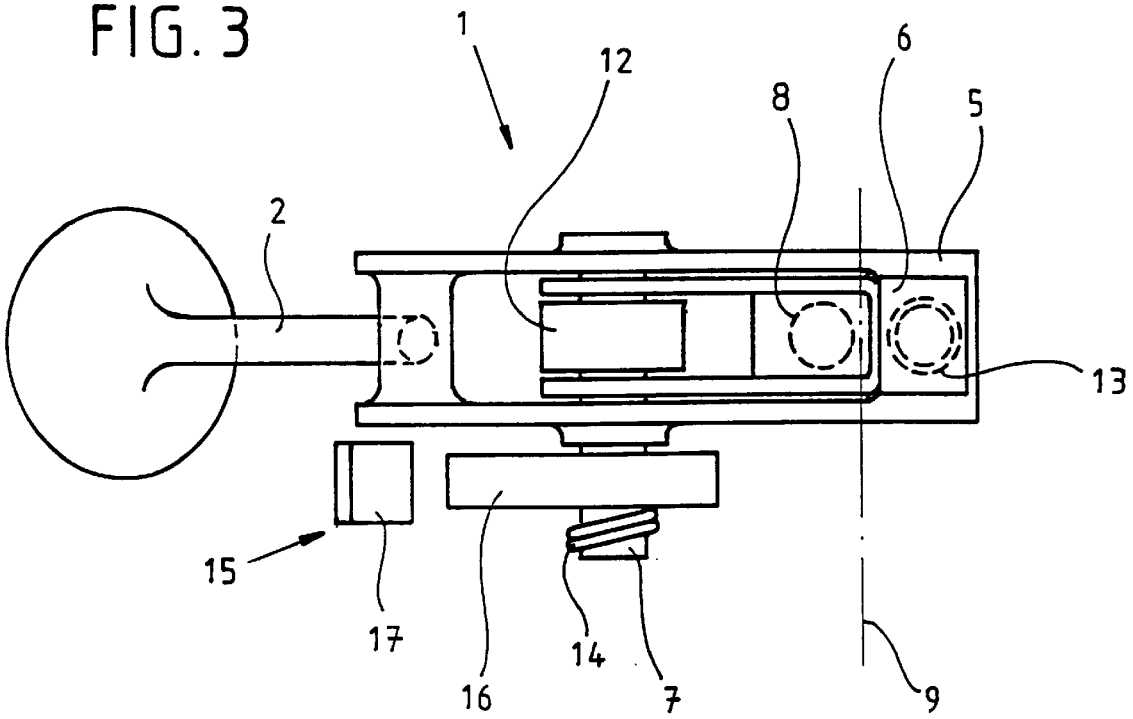

FIG. 1 shows a schematic diagram of the device claimed for the invention with force flow present;

FIG. 2 a schematic diagram of the device claimed for the invention with force flow interrupted; and FIG. 3 a top view of the device shown in FIGS. 1 and 2.

The device acts to interrupt the force flow between a valve 2 and a cam 3 of a camshaft 4.

For this purpose the device 1 comprises a first external actuating lever 5 which operates in conjunction with the valve 2, a second internal actuating lever 6 which operates in conjunction with the cam 3 of the camshaft 4, and a rotatable coupling element 7, which, depending on the rotary position, couples together or uncouples the first and second actuating levers 5, 6. When the two actuating levers 5, 6 are coupled, a force flow is present between the valve 2 and the cam 3, while the force flow between the valve 2 and the cam 3 is interrupted when the two actuating levers 5, 6 are uncoupled.

As is illustrated in FIGS. 1 and 2, the first external actuating lever 5 is mounted on a stationary compensation element 8 and carries a swivel pin 9 for mounting the second, internal, actuating lever 6. The swivel pin 9 is mounted relative to the compensation element 8 on the side of the first actuating lever 5 opposite the valve 2.

The rotary coupling element 7 is mounted in the second, internal, actuating lever 6 parallel to the swivel pin 9. In the area of its mounting in the first actuating lever 5 the coupling element 7 has a circular cross-section and in the area of its engagement with the second actuating lever 6 a cross-section such that in the first rotary position shown in FIG. 1 it is engaged in an undercut 10 of a curved recess 11 in the first actuating lever 5, and such that it is disengaged in the second rotary position shown in FIG. 2.

By means of a freely rotating roller 12 the coupling element 7 mounted in the second actuating lever 6 is brought into contact with at least one cam 3 of the camshaft 4, there being provided on the side opposite the swivel pin 9, between the first and the second actuating levers 5, 6, a spring element 13 which pivots the coupling element 7 mounted with the roller 12 in the second actuating lever 6 into contact with at least one cam 3.

The rotary coupling element 7 is provided on one of its free ends with a first mechanical rotating mechanism 14 which moves the coupling element 7 into the first rotary position. This first rotating mechanism 14 is in the form of a torsion bar. In addition, the coupling element 7 is connected to a second mechanical rotating mechanism 14' which moves the coupling element 7 into the second rotary position. This second mechanical rotating mechanism 14' is in the form of a special cam on the camshaft 4. On its free end the coupling element 7 is in addition connected to a magnetic locking mechanism 15 which consists of a magnetizable lever 16 and a locking magnet 17. The magnetizable lever 16 is connected to the second mechanical rotating mechanism 14'. If the magnetic locking mechanism 15 is now activated, the coupling element 7 can be kept in the second rotary position despite the decreasing support of the second mechanical rotating mechanism 14'.

As soon as the magnetic locking mechanism 15 is deactivated, the coupling element 7 is moved by the first mechanical rotating mechanism 14 back to the first rotary position.

What is claimed is:

1. A device interrupting the force flow between at least one valve and at least one cam of a camshaft, in a valve drive of a reciprocating internal combustion engine, with a first actuating lever which operates in conjunction with the at least one valve and is mounted on at least one stationary compensation element, a second actuating lever which is pivotably mounted on the first actuating lever and which operates in conjunction with the at least one cam of the camshaft, and a rotary coupling element which is mounted parallel to a swivel pin of the second actuating lever and which in its first position couples the two actuating levers to each other and which in a second position decouples the two actuating levers, characterized in that the rotary coupling element is mounted in the second actuating lever and carries at least one freely rotating roller, the roller being in contact with the at least one cam of the camshaft.

2. A device as described in claim 1, wherein the rotary coupling element has in an area of its engagement with the first actuating lever a cross-section such that in its first rotary position it engages the undercut of a curved recess in the first actuating lever and is disengaged in the second rotary position, and wherein the coupling element may be moved, at all times prestressed, into the first rotary position by means of a first mechanical rotating mechanism and into the second rotary position by means of a second mechanical or hydraulic rotating mechanism.

3. A device as described in claims 1 and 2, wherein the second mechanical or hydraulic rotating mechanism operates periodically and can be retained in the second rotary position by means of an electromagnetic locking mechanism.

4. A device as described in claim 3, wherein the second mechanical rotating mechanism is a special cam on the camshaft.

* * * * *